US008579165B2

(12) United States Patent
Kim

(10) Patent No.: US 8,579,165 B2
(45) Date of Patent: Nov. 12, 2013

(54) PUSH PUMP DEVICE

(76) Inventor: Yoon Ki Kim, Seoul (KR)

( * ) Notice: Subject to any disclaimer, the term of this patent is extended or adjusted under 35 U.S.C. 154(b) by 181 days.

(21) Appl. No.: 13/193,639

(22) Filed: Jul. 29, 2011

(65) Prior Publication Data

US 2012/0024910 A1 Feb. 2, 2012

Related U.S. Application Data

(60) Provisional application No. 61/369,081, filed on Jul. 30, 2010.

(51) Int. Cl.
*B67D 7/58* (2010.01)

(52) U.S. Cl.
USPC ..... 222/382; 222/464.1

(58) Field of Classification Search
USPC ..... 222/382, 464.1, 377, 321.5, 321.1, 222/321.7–321.9, 383.1, 383.3, 386, 386.5
See application file for complete search history.

(56) References Cited

U.S. PATENT DOCUMENTS

| | | | | |
|---|---|---|---|---|
| 2,081,253 | A * | 5/1937 | Serre | 222/207 |
| 2,767,890 | A * | 10/1956 | Carter | 222/386 |
| 2,950,031 | A * | 8/1960 | Abplanalp et al. | 222/402.1 |
| 3,062,415 | A * | 11/1962 | Anderson | 222/320 |
| 3,144,968 | A * | 8/1964 | Martino et al. | 222/380 |
| 3,194,450 | A * | 7/1965 | Van Brocklin | 222/402.1 |
| 3,223,295 | A * | 12/1965 | Falerni et al. | 222/438 |
| 3,471,065 | A * | 10/1969 | Malone | 222/321.1 |
| 5,435,464 | A * | 7/1995 | Alexander et al. | 222/105 |
| 8,245,890 | B2 * | 8/2012 | Koch | 222/464.1 |
| 2011/0011895 | A1 * | 1/2011 | Michitsuji et al. | 222/382 |

* cited by examiner

*Primary Examiner* — Paul R Durand
*Assistant Examiner* — Donnell Long
(74) *Attorney, Agent, or Firm* — Park, Kim & Suh, LLC

(57) ABSTRACT

A pump type dispenser that is able to suction a maximum amount of product that is held within a container. In order to achieve this result, the pump type dispenser utilizes a suction mouth portion that is positioned along a bottom portion of the container. The pump type dispenser may also utilize a plurality of straw type extensions to reach a plurality of locations along the bottom portion of the container in order to suction a maximum amount of product that is held within the container.

9 Claims, 11 Drawing Sheets

PUSH PUMP DEVICE

This application claims the benefit of U.S. Provisional Patent Application No. 61/369,081 filed on Jul. 30, 2010, which is hereby incorporated by reference as if fully set forth herein.

BACKGROUND OF THE INVENTION

1. Field of the Invention

The present invention relates to a push pump device, and more particularly, to a push pump for efficiently and conveniently suctioning out a maximum amount of content from a container.

2. Discussion of the Related Art

Push type pumps are utilized in many facets of everyday life. They are used to dispense everything from liquid soap, shampoo, condiments, and just about anything else that can be pumped out of a container.

Ideally a user will want the push pump to dispense all of the contents of the container in order to make full use of the entire product that was paid for. While the traditional straw design is able to reach the bottom of a container, it has been a frustrating deficiency of the common push pump design that a portion of product inevitably remains. This is because only a single tubular design has been used for the design of the straw portion that is utilized to suck the contents of the container from the bottom of the container.

The only option left to users of this single tube straw design who desired to obtain the remaining product that could not be reached using the single tube straw design, was to detach the push pump from the container and manually extract the remaining product. This is a cumbersome task that defeats the purpose and convenience of extracting the entire product using just the push pump.

Therefore there is a need for an improved push pump device that will succeed in suctioning all of the contents from a container in a convenient manner

SUMMARY OF THE INVENTION

Accordingly, the present invention relates to a push pump device for dispensing content from a container that is directed to obviate the disadvantages of the traditional push pump dispensing device and corresponding straw portion design. Therefore it is an object of the present invention to provide a push pump device for efficiently and conveniently suctioning out a maximum amount of content from a container.

It is another object of the present invention to provide an improved straw portion design for efficiently and conveniently suctioning out a maximum amount of content from a container.

Additional advantages, objects and features of the invention will be set forth in part in the description which follows and in part will become apparent to those having ordinary skill in the art upon examination of the following, or may be learned from practice of the invention. The objectives and other advantages of the invention may be realized and attained by the structure particularly pointed out in the written description and claims hereof as well as the appended figures.

To achieve these objects and other advantages and in accordance with the purpose of the invention, as embodied and broadly described herein, according to an aspect of the present invention, a push pump device for use in dispensing the contents of a container is provided that includes a top dispensing head portion, a pump mechanism portion that is connected to the top dispensing head portion for generating an upward suction force when the top dispensing head portion is pressed, a straw portion that is connected to the pump mechanism portion for suctioning contents inside of the container to be dispensed through the top dispensing head portion and a suction mouth portion that is connected to the straw portion, wherein the suction mouth portion forms holding chamber with a bottom portion of the container and includes a plurality of openings such that contents outside of the holding chamber are sucked into the holding chamber and into the straw portion when the top dispensing head portion is pressed.

In another aspect of the present invention, the push pump device for dispensing the contents of a container is provided that includes a top dispensing head portion, a pump mechanism portion that is connected to the top dispensing head portion for generating an upward suction force when the top dispensing head portion is pressed, a straw portion that is connected to the pump mechanism portion for suctioning contents inside of the container to be dispensed through the top dispensing head portion, and a plurality of suction extensions that is connected to the straw portion, wherein ends of the suction extensions are extended to a bottom peripheral portion of the container.

In a further aspect of the present invention, the push pump device for dispensing the contents of a container is provided that includes a top dispensing head portion, a pump mechanism portion that is connected to the top dispensing head portion for generating an upward suction force when the top dispensing head portion is pressed and a plurality of straw portions connected to the pump mechanism portion for suctioning contents inside of the container to be dispensed through the top dispensing head portion, wherein ends of the straw portions are extended to a bottom peripheral portion of the container.

And in a further aspect of the present invention, the pump mechanism portion is provided with a unique shape design that is able to provide increased efficiency.

It is to be understood that both the foregoing general description and the following detailed description of the present invention are exemplary and explanatory and are intended to provide further explanation of the invention as claimed

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
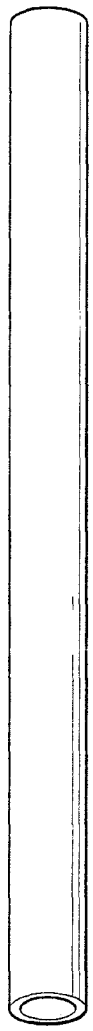
FIG. 1 Prior Art
FIG. 1 illustrates a single tube straw design as known in the prior art.
Figure 2:
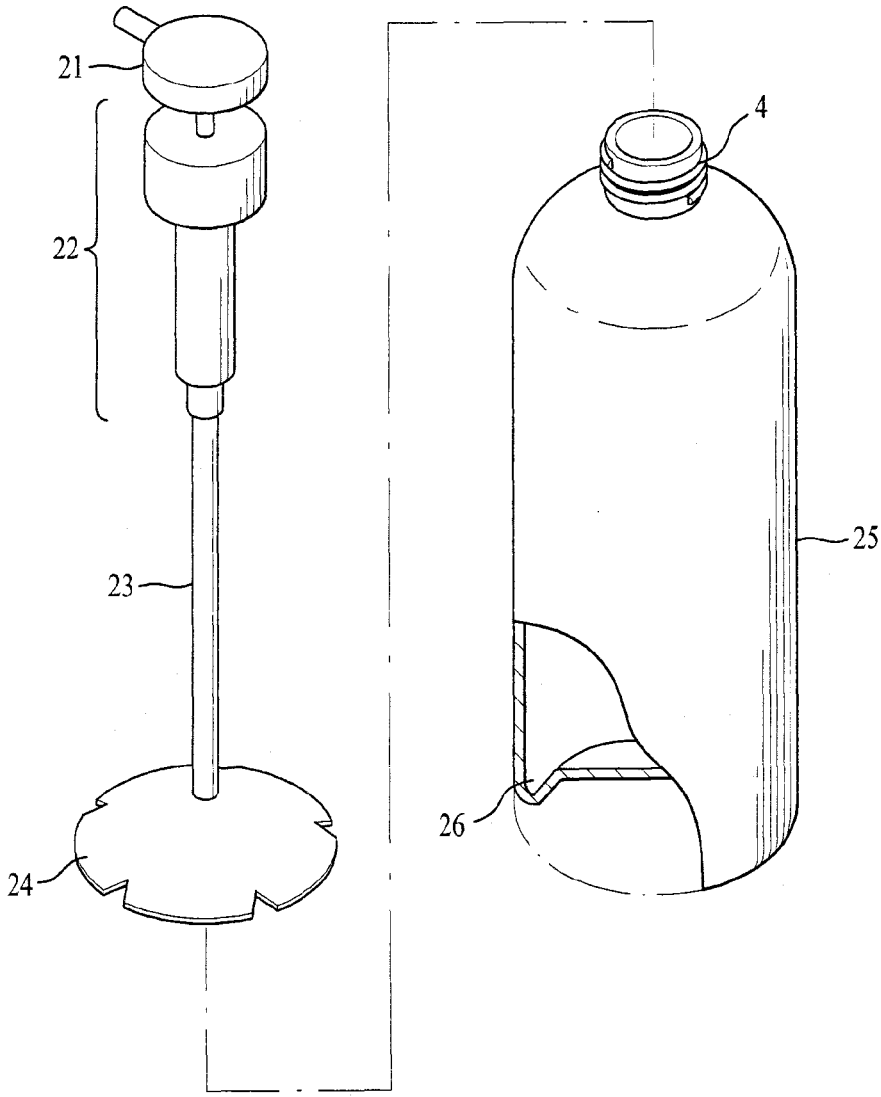
FIG. 2 illustrates a first embodiment of the push pump device according to the present invention.

FIG. 2 illustrates a first embodiment of the invention. A push pump device of the first embodiment includes four components: a top dispensing head portion 21, a pump mechanism portion 22, a straw portion 23 and a suction mouth portion 24. The push pump device is distinct from the container 25 and may be taken off the container 25 as needed. FIG. 2 is illustrated to show that the top dispensing head portion 21 and the pump mechanism portion 22 is detachable from the straw portion 23. However it is within the scope of the present invention to have all four components of the push pump device be a singular unit, independently detachable, or any combination in-between. Also, according to a preferred embodiment, the push pump device is secured to the container 25 by a threaded screw type fastening portion within the pump mechanism portion 22 that is secured to the threaded top neck portion of the container 25 as illustrated. However other means for securing the push pump device to the container 25 are within the scope of the invention.

The top dispensing head portion 21 serves the dual purpose of being the engaging member by which a user presses to initiate a pump sequence according to the present invention, and also serves to include a dispensing portion by which the contents of a container will ultimately be dispensed out of.

The pump mechanism portion 22 is connected to the top dispensing head portion 21, and serves to enable the "push pump" functionality of the present invention. So the top dispensing head portion 21 is connected to the pump mechanism portion such that when the top dispensing head portion 21 is pressed down to initiate the "push pump" function, components within the pump mechanism portion 22 is compressed and then expanded to then allow the top dispensing head portion 21 to return to its resting state. The compression and the expansion within the pump mechanism portion 22 is responsible for creating the suction effect for ultimately sucking up the contents of the container 25 and dispensing it out through the nozzle of the top dispensing head portion 21.

The straw portion 23 is connected to be between the pump mechanism portion 22 on one end and the suction mouth portion 24 at the other end. The straw portion 23 acts to transport the contents of the container that is sucked through the suction mouth portion 24 and brought up to be delivered to the pump mechanism portion 22. A diameter of the straw portion 23 will be made to maximize the transport of content as well as the suction effect that results from the push pump action of the pump mechanism portion 22.

The suction mouth portion 24 is attached at the end of the straw portion 23 and is preferably in the shape of a domed suction cup. The peripheral dimensions of the suction mouth portion 24 will preferably take on the form of the inner dimensions of the container in which the suction mouth portion 24 is inserted. Also a diameter of the suction mouth portion 24 in a natural state is made to be greater than a diameter of a portion of the container which is in contact with the suction mouth portion 24. This is done to ensure that the outer circumferential portion of the suction mouth portion 24 will be in contact with the inner wall of the container. Alternatively, the diameter of the suction mouth portion 24 may be equal to a diameter of a portion of the container which is in contact with the suction mouth portion 24. In the case that the inner surface dimensions of the container are irregular, the peripheral dimensions of the suction mouth portion 24 will be adapted accordingly to match the irregular dimensions of the container. This is also done to ensure that the outer circumferential portion of the suction mouth portion 24 will be in contact with the inner wall of the container.

FIG. 2 illustrates the push pump device being positioned in its operational state. In this operational state the peripheral of the suction mouth portion 24 is pressed against the inside walls of the container 25 such that a holding chamber is formed between the suction mouth portion 24 and the bottom portion of the container 25. It is presumed that the contents of the container 25 reside in this holding chamber, as well as above the suction mouth portion 24.

The bottom of the suction mouth portion is depicted as being slightly above the bottom of the container. This is done to create the mentioned holding chamber, where the holding chamber acts as a sort of vacuum chamber for pulling content that lays above the suction mouth portion 24 into the holding chamber as the previous contents of the holding chamber are sucked up through the straw portion 23 to be dispensed. FIG. 2 also illustrates a holding area dip portion 26 along the bottom peripheral circumference of the container 25. In such a case where the container 25 includes the holding area dip portion 26, the suction mouth portion 24 will ideally be able to dispense the content that lays in this holding area dip portion 26.

Once in this operational state, the push pump device operates by having the top dispensing head portion 21 pushed down into the pump mechanism portion 22. This downward pushing action creates a suction chamber reaction within the pump mechanism portion 22, which in turn creates a suctioning reaction through the straw portion 23 that sucks in the contents of the container 25 that resides in the holding chamber below the suction mouth portion 24. Openings of the suction mouth portion 24 exist around the circumference of the suction mouth portion 24 to suck in the contents that lay above the suction mouth portion 24 and into the holding chamber. This is done to replenish the holding chamber with more content to make up for the amount that was dispensed out through the straw portion 23 due to the pumping process. A more detailed explanation of the openings of the suction mouth portion 24 are provided below.

Although FIG. 2 illustrates the straw portion 23 and the suction mouth portion 24 being a single unit, it is within the scope of the present invention for the straw portion 23 and the suction mouth portion 24 to be separate pieces that are detachable and re-attachable from each other. In either case, the point at which the straw portion 23 and the suction mouth portion 24 meet will substantially be at center of the suction mouth portion 24.

Also, the suction mouth portion 24 can be made of an elastic material to ensure it is pliable enough to fit through the opening at the top of the container 25. Alternatively, the suction mouth portion 24 may be made of a hard plastic-type material to maintain its rigid dome shape. In the case where the suction mouth portion is made of a hard plastic-type material, the container 25 may be required to be opened at its bottom portion for insertion of the suction mouth portion 24 in case it is not small enough to fit in the top neck of the container 25. Or alternatively, the suction mouth portion 24 may be made of an elastic material and also have its thickness varied such that it is thicker at a center location of the suction mouth portion 24 and gradually becomes thinner towards the peripheral of the suction mouth portion 24. This allows the center portion of the suction mouth portion 24 to be sufficiently rigid, while the outer peripheral of the suction mouth portion 24 retains an elastic property. If the center portion is thick enough to accomplish a rigid form while the outer peripheral is made thinner to enable flexibility, then such a suction mouth portion 24 may still be able to be fit through the top neck of the container 25. Further descriptions related to the suction mouth portion will now be made.

Figure 3:
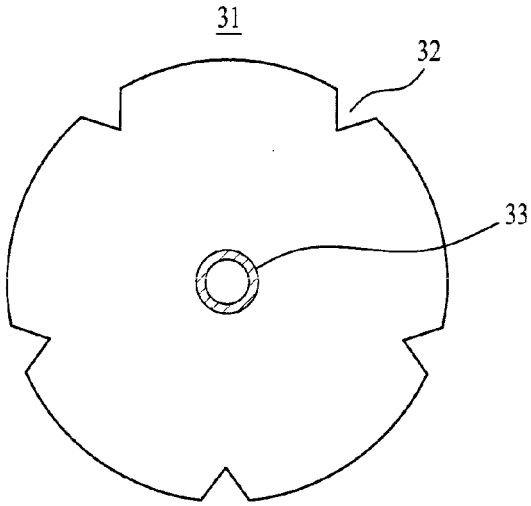
FIG. 3 illustrates a top-side view of a first suction mouth portion available for use in the push pump device according to the first embodiment of the present invention.

FIG. 3 is a top-side view of a first suction mouth portion 31 available for use in the first embodiment of the present invention. The first suction mouth portion 31 is configured to have five triangular shaped openings 32 around the peripheral circumference of the first suction mouth portion 31. Each of these openings are preferably equidistance apart and share a same size. In the center of the first suction mouth portion 31 is the straw opening 33 for connection to a straw portion.

Figure 4:
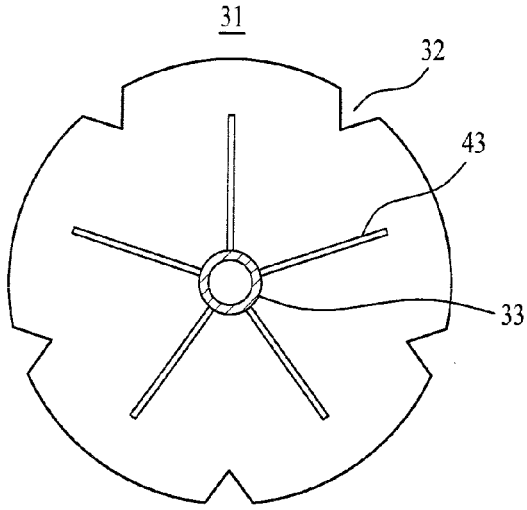
FIG. 4 illustrates a bottom-side view of the first suction mouth portion available for use in the push pump device according to the first embodiment of the present invention.

FIG. 4 illustrates a bottom-side view of the first suction mouth portion 31 according to the first embodiment of the present invention. It should be understood that the bottom-side of the first suction mouth portion 31 is intended to be the side that faces the bottom of a container in which the first suction mouth portion 31 is inserted. The bottom-side view of the first suction mouth portion 31 additional illustrates five protruding guides 43 on the bottom-side of the first suction mouth portion 31 that are directed toward the center of the suction mouth portion 31 where the straw opening 33 for the connection to a straw portion is placed. These five protruding guides 43 server to guide the container's content that are held within a holding area towards the straw entrance 33. The protruding guide rails 43 will raise up above the plane surface of the rest of the first suction mouth portion 31.

Figure 5:
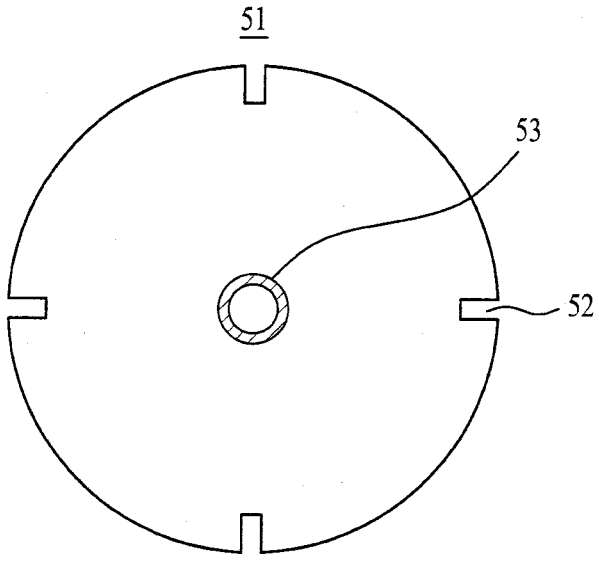
FIG. 5 illustrates a top-side view of a second suction mouth portion available for use in the push pump device according to the first embodiment of the present invention.

And FIG. 5 illustrates a top-side view of an alternative second suction mouth portion 51 available for use according to the first embodiment of the present invention. This second suction mouth portion 51 example is made to show four rectangular shaped openings 52 that are placed around the peripheral circumference of the second suction mouth portion 51. The rectangular shaped openings 52 are preferably the same size and also spaced to be equidistance apart from each other. All contents that are held within a holding area that is created by this second suction mouth portion 51 will then be sucked out for dispensing through a straw opening 53 that is located at the center of the suction mouth portion 51.

While the openings have been expressly illustrated to be a triangular shaped opening 32 in FIG. 3, and rectangular shaped openings 52 in FIG. 5, it is within the scope of the present invention for the openings to take on other reasonable shapes. For instance the openings may be in the shape of a square, trapezoid, circular and even thin slit-like openings. In addition, although the number of openings have been expressly been disclosed to be either four or five, it is within the scope of the present invention for the number of openings be within the range of a single opening to any number of a plurality of openings.

The size of each opening may have a direct correlation to the number of openings that are required to ensure efficient flow of content through the suction mouth portion. For instance a single opening may be viable if the single opening has a significant size. And on the other end of the spectrum, significantly smaller openings may be viable if the openings are positioned to be placed all throughout the surface of the suction mouth portion instead of being confined to just the peripheral circumference. Thus although not specifically illustrated, instead of the openings of the suction mouth portion being placed along the outer peripheral circumference, alternatively the openings may be brought in towards the center of the suction mouth device. According to this alternative, then, the outer peripheral circumference of the suction mouth device will not have any openings interrupting its form.

The size of the openings and the number of openings may also depend upon the type of content that is held by the container that will apply to the push pump device of the present invention. Content having lower viscosity may be able to flow through smaller sized openings than would be required for content having greater viscosity. This is because content having lower viscosity offer less resistance (ie. thicker substances), whereas content having higher viscosity offer greater resistance (ie. thinner substances).

The openings 32 and 52 as illustrated in FIGS. 3-5 are of a size, spacing and shape that allow for efficient movement of container content to flow through the suction mouth openings. These openings not only allow for the sucking up of content from the bottom of a container for dispensing, but also must serve the function of allowing content to flow through the suction mouth portion when initially inserting the push pump device into a container full of content. This process is explained with detail below.

Figure 6:
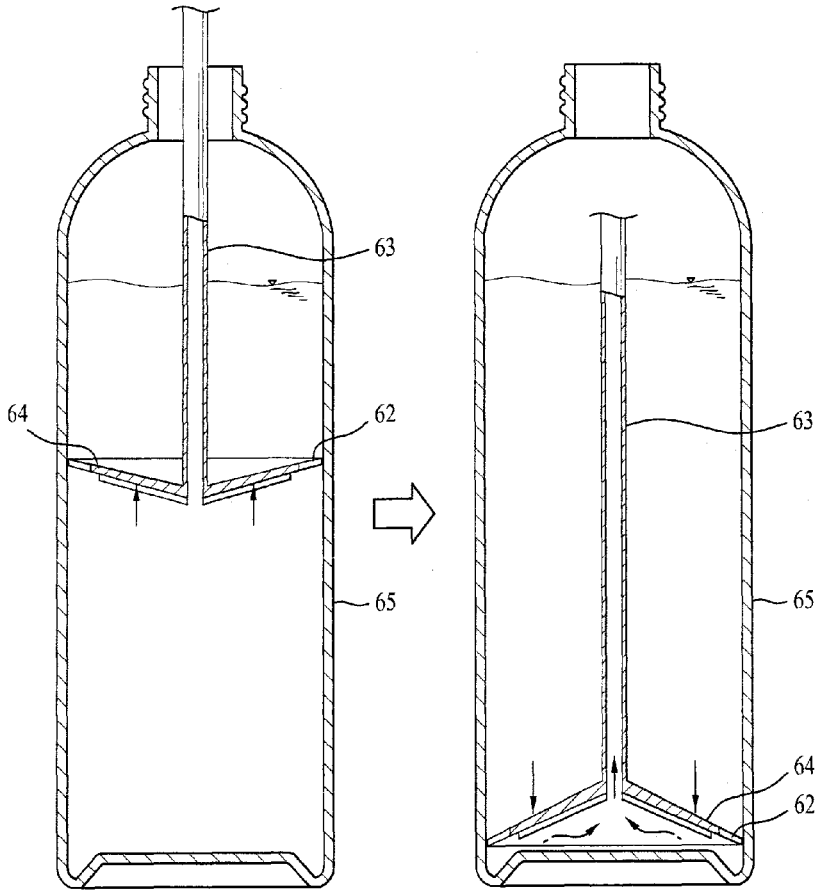
FIG. 6 illustrates the process of initially pushing the push pump device of the present invention into a container that is filled with content.

FIG. 6 illustrates the process involved when initially inserting the push pump device into a container full of content. As illustrated and described previously, preferably there are a plurality of openings that are positioned along the peripheral circumference of the suction mouth portion. The view point of FIG. 6 depicts such openings 62 to be positioned along a peripheral circumference of the suction mouth portion 64 that is in contact with the sides of the container 65. So when initially inserting the suction mouth portion 64 into the container 65 full of content, the content may be pushed up through the openings 62 to allow the suction mouth portion to settle near the bottom of the container 65. During this initial stage of inserting the suction mouth portion 64 into the container 65 full of content, the openings 62 actually serves to allow the content to flow up from the bottom of the suction mouth piece 64 and out through the top of the suction mouth portion 64 as depicted by the arrows. In this manner the openings 62 allows the suction mouth portion 64 to settle down at the bottom of the container 65 along a holding area. This is depicted by the left side of FIG. 6. Although the left side of FIG. 6 depicts the suction mouth portion 64 being made of a flexible material such that the suction mouth portion 64 may be inverted when initially inserting it into the container, it is within the scope of this invention that the suction mouth portion is made of a rigid material that will allow the suction mouth portion 64 to maintain its dome shaped form even during this initial insertion step. The dome shaped form of the suction mouth portion 64 in its operational state is depicted on the right side of FIG. 6.

When the suction mouth portion settles at the bottom of the container 65, there will inevitably be some content left underneath it. This area between the bottom of the container and the suction mouth portion is what is referred to as the holding chamber. So once the suction mouth portion 64 reaches the holding chamber as seen on the right side of FIG. 6, the push pump device is ready operate.

When the push pump process is initiated as explained above, the content held in the holding area will be sucked up through the straw portion 63 and dispensed out of the top dispensing head portion (not pictured). At the same time that the content remaining in the holding area is sucked out though the straw portion 63, additional content that lays on top of the suction mouth portion 64 is sucked into the holding area through the openings 62. This process is indicated by the arrows that indicate the flow of the content being sucked into the holding area.

If the suction mouth portion is made of a flexible material, the push pump process that is initiated when the top dispensing head portion is pressed may enable the straw portion 63 to move downward. By having the straw portion 63 move downward with the pressing of the top dispensing head portion, the suction mouth portion 64 will in turn be compressed downward to reduce a volume of the holding chamber. This may increase a vacuum effect within the holding chamber and result in a stronger pumping effect of content being sucked out from the holding chamber. Also, the downward motion of the straw portion 63 with the pressing of the top dispensing head portion may additionally result in a lower end of the straw portion 63 move into a position within the holding chamber itself.

While the description of the first embodiment assumed that the push pump device is inserted into a container full of content, it is within the scope of the present invention for the push pump device to be inserted into an empty container prior to it being filled will content.

Figure 7:
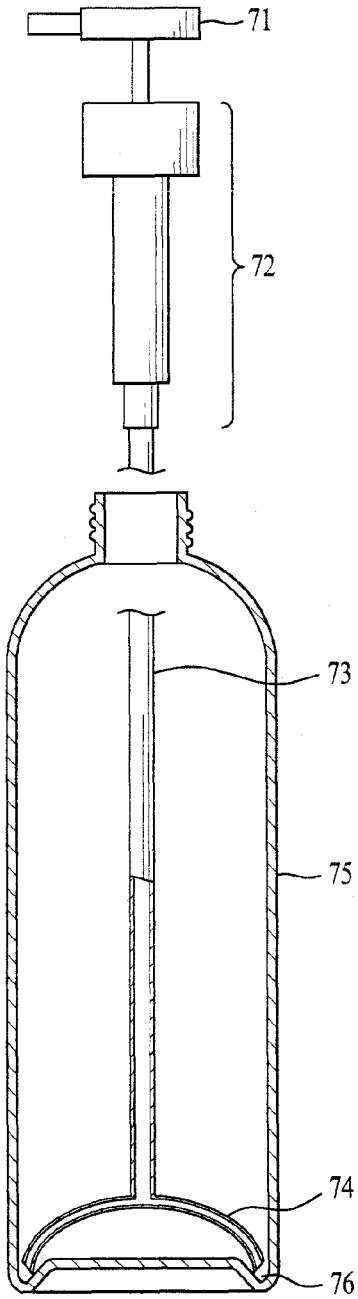
FIG. 7 illustrates a second embodiment of the push pump device according to the present invention.

FIG. 7 illustrates a second embodiment of the present invention where the circular suction mouth portion is replaced by a plurality of suction extensions. A push pump device of the second embodiment includes a top dispensing head portion 71, a pump mechanism portion 72, a straw portion 73 and a suction extensions portion 74 attached to the end of the straw portion 73. The suction extensions portion 74 may be integrated with the straw portion 73 as a single unit, or may be an attachment that is separate from the straw portion 73. The push pump device is distinct from the container 65 and can be secured and unsecured from the container 75 as needed.

Ideally, the suction extensions portion 74 will be able to reach into any run-off reservoirs 76 that may exist at the bottom of a container if such run-off reservoirs exist.

Figure 8:
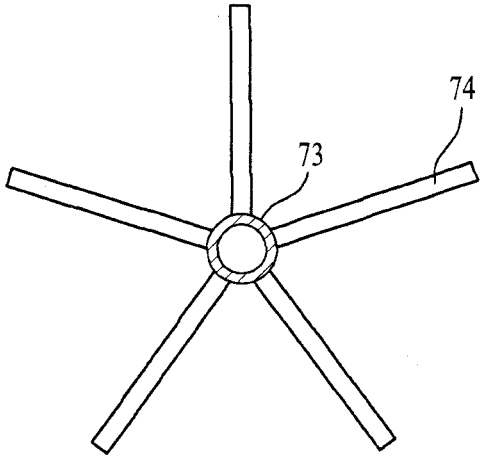
FIG. 8 illustrates a top-side view of suction extension portions available for use in the push pump device according to the second embodiment of the present invention.

FIG. 8 illustrates a top-side view of the plurality of suction extensions that comprise the suction extensions portion 74. In FIG. 8 the suction extensions portion is depicted as having five extensions. And each of these plurality of extensions of the suction extensions portion 74 will ideally be spaced an equidistance apart. Each of these extensions are hollowed out tubes that are able to take content at the bottom of the container 75 and suck it through to be delivered to the straw portion 73. Also, the ends of the suction extensions 74 may be cut diagonally to prevent being stuck to a flat inner surface of the container 75 when the suction is initiated. This is an improvement in view of the prior art straw shape that is cut in a flat manner and thus runs the risk of being stuck to a flat inner surface of a container when a suction is initiated.

To begin operation, the push pump device must first be inserted into the container beginning with fitting the suction extensions portion 74 through the top neck opening of the container. The push pump device is then secured to the container and the suction extensions portion 74 will ideally be settled to the bottom of the container bottom. Once the push pump device is inserted into the container 75 such that the suction extensions portion 74 reaches the bottom surface of the container 75, the pump mechanism is initiated so that the contents of the container will be suctioned through the suction extensions portion 74 and then to the straw portion 73. And via the straw portion 73, the content that is at the bottom of the container will be sucked in through the openings of the suction extensions portion 74, sucked up through the straw portion, through the pumping mechanism portion 72, and finally dispensed through the top dispensing head portion 71.

Although FIG. 8 illustrates the suction extensions portion 74 having five extensions, this should not be seen as limiting the number of suction extensions to just five. It is within the scope of the present invention that the suction extensions portion 74 is comprised of any number of a plurality of extensions. The number of extensions will depend on a variety of factors. For instance the number of suction extensions may correlate to a number of run-off reservoirs lining the circumference of the bottom of the container. In that case, a suction extension will be provided for each run-off reservoir to ensure the maximum amount of content will be suctioned up for dispense.

The push pump device of the second embodiment can be inserted into a container either holding content or not. The plurality of suction extensions of the suction extensions portion 74 ensures the maximum amount of content will ultimately be dispensed through the top dispensing head portion 71. Also, the suction extensions portion 74 of this second embodiment may offer the benefit over the circular suction mouth portion of the first embodiment of initially being easier to insert into a container. This is especially true when the top access hole of the container is narrow.

As mentioned previously, the push pump device according to this second embodiment may further be used with a special container that has incorporated a number of run-off reservoirs 76 circling the entire circumference of the bottom of the container. The container may include a single run-off reservoir that runs along the peripheral circumference on the bottom of the container, or may include a plurality of separate and distinct run-off reservoirs along the bottom of the container. The run-off reservoir operates by allowing the content stored in the container to be directed towards the run-off reservoir. So by the time that a minimum amount of content remains, the last of the contents will all end up in one of these run-off reservoirs that lays at the bottom of the container. To correlate to each run-off reservoir of the container, this second embodiment looks to provide a corresponding suction extension. By having a suction extension assigned to each run-off reservoir of the container, the maximum amount of content can be dispensed out of the container.

Figure 9:
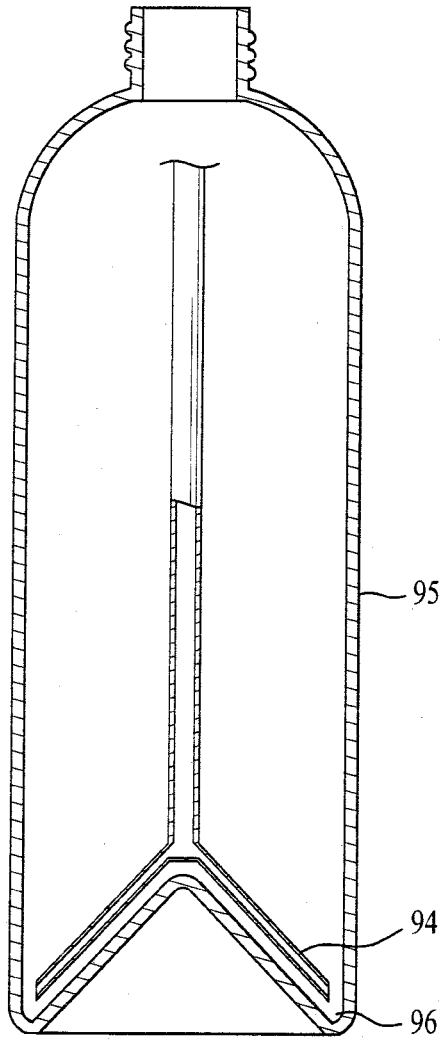
FIG. 9 illustrates a container having a cone shaped bottom portion that is to be used with the push pump device of the present invention.

FIG. 9 illustrates a profile view of a container 95 having a cone shaped bottom portion and a plurality of run-off reservoirs 96 circling the circumference of the bottom of the container 95. The content at the bottom of the container 95 will run off the cone shaped bottom and into the plurality of run-off reservoirs 96. And a plurality of suction extensions 94 will then be configured to suction content from each of the run-off reservoirs 96 for dispensing. This ensures a maximum amount of content will be dispensed. The bottom of the container 95 as illustrated in FIG. 9 contains a plurality of run-off reservoirs to maximize efficiency, but any number of configurations for the bottom of the container 95 is also within the scope of the present invention. For example a single run-off reservoir may circle the peripheral circumference of the bottom of the container 95.

Figure 10:
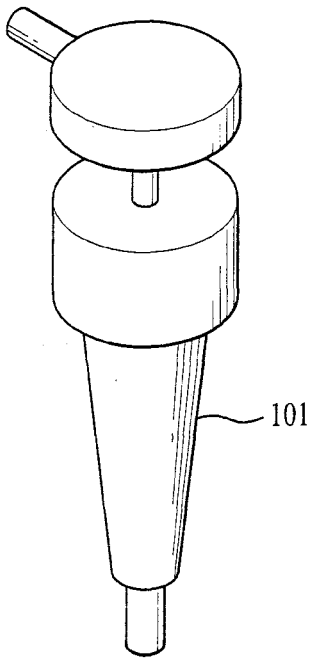
FIG. 10. Illustrates an alternative pump mechanism portion design that is available for use in the push pump device according to the present invention.

FIG. 10 illustrates an alternative pump mechanism portion 101 that includes a funnel-like shape housing design. This alternative housing design allows for remaining container content within the alternative pump mechanism portion 101 itself to better slide down the inner surface of the pump mechanism portion 101 and towards the straw opening. Then the contents may exit the pump mechanism portion 101 and be released back with content that resides in a holding area below at the bottom of the container where it can be dispensed at a later time. This alternative pump mechanism portion 101 design is especially efficient for thicker container content to slide down the inner surface of the housing over the traditional parallel wall design. The design of the alternative pump mechanism portion 101 as illustrated in FIG. 10 can be implemented with all the disclosed embodiments of the invention, as well as all variations.

Figure 11:
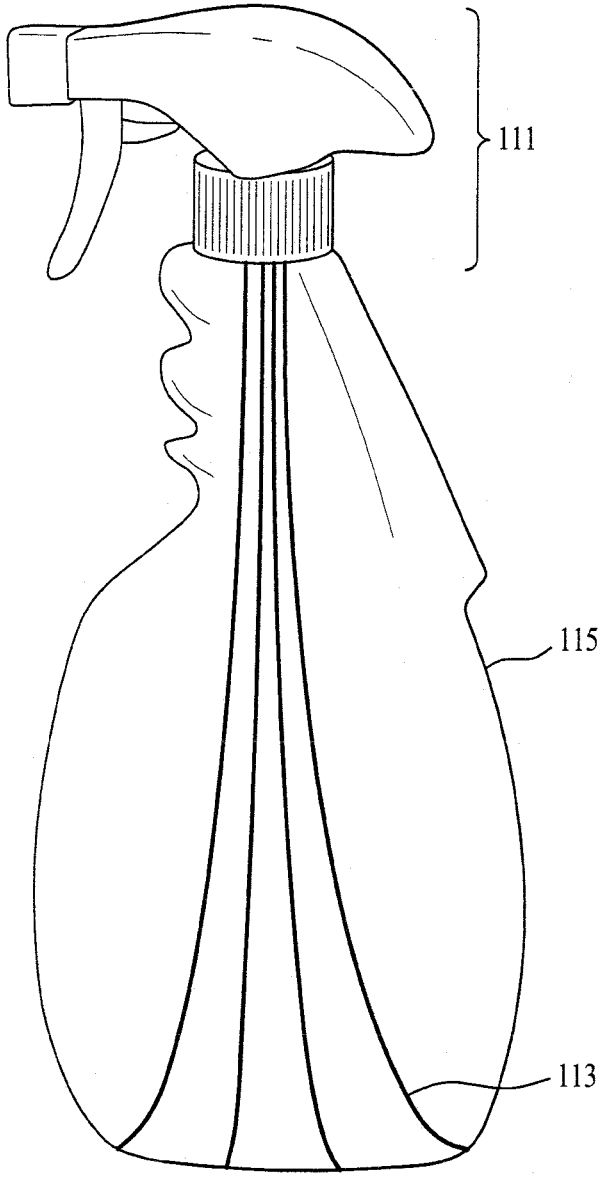
FIG. 11 illustrates a third embodiment of the push pump device according to the present invention.

FIG. 11 illustrates a third embodiment of the present invention where the straw portion of the push pump device is actually a plurality of individual straw extensions 113. In this third embodiment there is no need for an additional suction mouth portion at the end of the straw extensions 113. Each of the plurality of straw extensions that comprise the straw extensions 113 are hollow to allow for the contents of the container to be sucked up through the straw extensions 113.

FIG. 11 also illustrates an alternative bottle 115 design as well as an alternative top dispensing head portion 111. The alternative top dispensing head portion 111 takes the form of a spray lever type pump as opposed to the push pump type top dispensing head portion of the first and second embodiments. The spray lever type pump design may be implemented for the first and second embodiments, and vice versa the push pump type pump design may be implemented for the third embodiment of this present invention.

Figure 12:
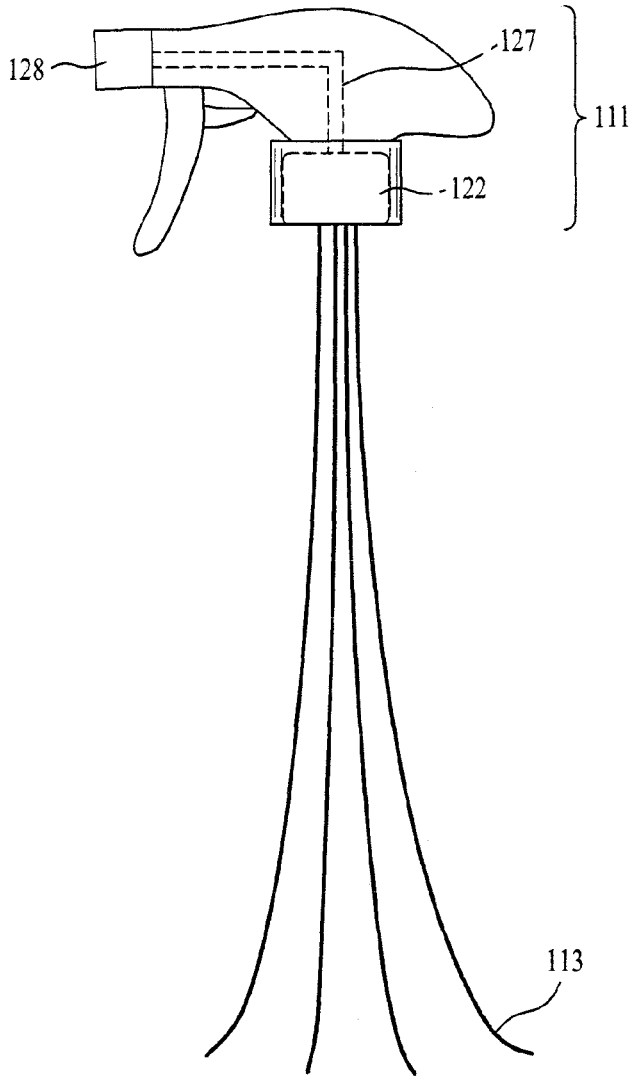
FIG. 12 illustrates a side-sliced view of the third embodiment of the push pump device according to the present invention

FIG. 12 provides a side-sliced view of the spray lever type pump design top dispensing head portion 113 according to this third embodiment of the present invention. The side-slice view of the spray lever type pump design top dispensing head portion 111 shows that it is actually comprised of a grouping portion 122, tube portion 127 and a nozzle portion 128. The grouping portion 122 gathers the content that has been sucked up from the bottom of the container 115 via the plurality of straw extensions 113. The tube portion transports the residing contents within the grouping portion 122 and sends it to the nozzle portion 128. And the nozzle portion 128 ultimately dispenses the contents. The advantage of the plurality of straw extensions that make up the straw extensions 113 according to this third embodiment is the ease with which it can be inserted into a container with a narrow top opening. The straw extensions 113 according to this third embodiment also offer advantages when the contents of the container have a lower viscosity property.

The foregoing description presents preferred embodiments of the push pump device. However the description should not be interpreted in a limiting sense as various modifications and changes may be made without departing from the scope of the invention It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A push pump device for a container comprising:

a top dispensing head portion;

a pump mechanism portion connected to the top dispensing head portion for generating an upward suction force when the top dispensing head portion is released;

a straw portion connected to the pump mechanism portion for suctioning contents inside of the container to be dispensed through the top dispensing head portion; and a suction mouth portion connected to the straw portion, wherein the suction mouth portion forms a holding chamber with a bottom portion of the container and includes a plurality of openings such that contents outside of the holding chamber are sucked into the holding chamber and into the straw portion when the top dispensing head portion is released, wherein the suction mouth portion is elastic and a diameter of the suction portion in a natural state is greater than a diameter of a portion of the container which is in contact with the suction mouth portion.

2. The push pump device of claim 1, wherein a circumferential portion of the suction mouth portion is always in contact with an inside wall of the container.

3. The push pump device of claim 1, wherein the plurality of the openings are located at a circumferential portion of the suction mouth portion.

4. The push pump device of claim 1, wherein the suction mouth portion has a plurality of protruding guides directed toward a center of the suction mouth portion.

5. The push pump device of claim 1, wherein the straw portion moves downward when the top dispensing head portion is pressed.

6. The push pump device of claim 5, wherein a lower end of the straw portion is within the holding chamber.

7. The push pump device of claim 1, wherein the suction mouth portion is compressed downward to reduce a volume of the holding chamber when top dispensing head portion is pressed.

8. The push pump device of claim 1, wherein the pump mechanism portion is in a funnel shape so that a circumference at the top of the pump mechanism portion is greater than a circumference at the bottom of the pump mechanism portion.

9. A push pump device for a container comprising:

a top dispensing head portion;

a pump mechanism portion connected to the top dispensing head portion for generating an upward suction force when the top dispensing head portion is released;

a straw portion connected to the pump mechanism portion for suctioning contents inside of the container to be dispensed through the top dispensing head portion; and a suction mouth portion connected to the straw portion, wherein the suction mouth portion forms a holding chamber with a bottom portion of the container and includes a plurality of openings such that contents outside of the holding chamber are sucked into the holding chamber and into the straw portion when the top dispensing head portion is released, wherein a diameter of the suction mouth portion is equal to a diameter of a portion of the container which is in contact with the suction mouth portion.

* * * * *